US005225008A

United States Patent [19]

Koyama et al.

[11] Patent Number: 5,225,008

[45] Date of Patent: Jul. 6, 1993

[54] METHOD FOR MANUFACTURING A HIGH-STRENGTH SPRING

[75] Inventors: Hiroshi Koyama; Yasuo Sato; Katsuyuki Nishioka; Akira Tange; Tadayoshi Akutsu, all of Yokohama, Japan

[73] Assignee: NHK Spring Co., Ltd., Yokohama, Japan

[21] Appl. No.: 851,989

[22] Filed: Mar. 13, 1992

[30] Foreign Application Priority Data

Nov. 18, 1991 [JP] Japan ..... 3-301955

[51] Int. Cl.[5] ..... C21D 9/02

[52] U.S. Cl. ..... 148/580; 148/908

[58] Field of Search ..... 148/580, 908, 320, 334, 148/333

[56] References Cited

U.S. PATENT DOCUMENTS 5,118,469 6/1992 Abe et al. ..... 148/908

FOREIGN PATENT DOCUMENTS 58-213825 12/1983 Japan ..... 148/580

62-147155 6/1987 Japan .

*Primary Examiner*—Deborah Yee

*Attorney, Agent, or Firm*—Frishauf, Holtz, Goodman & Woodward

[57] ABSTRACT

A spring steel containing 0.35 to 0.50% of carbon is refined to the hardness of $\phi$ 2.50 to 2.70 mm in Brinell indentation diameter (HBD) by rapid cooling for quenching and tempering. This spring steel is subjected to warm shot peening at a temperature of 150° to 300° C. (423 to 573 K.) by using long-lived practical shots with the normal hardness of $\phi$ 2.65 to 2.80 mm in HBD, whereupon a high-strength spring is obtained having a compressive residual stress in its surface and enjoying the maximum shearing stress of 110 to 135 kgf/mm$^2$ (1080 to 1325 MPa).

5 Claims, 6 Drawing Sheets $\tau_m \pm \tau_a = 65 \pm 55$ kgf/mm² (637±540 MPa)

| | NUMBER OF CYCLES TO FAILURE (x 10⁴) 10 20 30 40 50 |
|---|---|
| CONVENTIONAL SP | ●● ●● |
| HIGH HARDNESS SP | ●●●● |
| W SP | ●●●→→→→→ |

METHOD FOR MANUFACTURING A HIGH-STRENGTH SPRING

BACKGROUND OF THE INVENTION

Field of the Invention

The present invention relates to springs, such as coils springs, leaf springs, torsion bars, etc., used in, for example, a vehicular suspension system, and more particularly, to a high-strength spring strengthened for lightweight design or other purpose and a manufacturing method therefor.

Description of the Related Art

Coil springs, for example, can be reduced in weight if their permissible maximum stress or design stress is increased. The design stress of the coil springs depends mainly on their durability and creep resistance. Conventionally, the failure rate of coil springs on the market is extremely low, and their durability arouses no problem. In general, therefore, the improvement of the creep resistance has been the most important problem to be solved.

Heretofore, both the aspects of materials and processing have been taken into consideration in improving the creep resistance of the coil springs. As regards the materials, there is a proposal to use a coil spring steel (SUP7) with increased content of silicon, as an element for increasing the strength of Ferrite, or a coil spring steel (SUP12V) additionally containing vanadium as a crystal grain refining element. In the aspect of processing, on the other hand, the creep resistance used to be improved by warm setting. The SUP7 and SUP12V, which are spring steels defined by Japanese Industrial Standard (JIS) No. G4801, are equivalent to Society of Automotive Engineers (SAE) No. 9260.

When using the prior art as described above, however, the maximum design stress ($\tau$ max) for the fatigue life not shorter than a fixed level is 110 kgf/mm$^2$ (1080 MPa), and a higher design stress cannot be obtained. The reason for this will now be described in connection with the conventional spring steels.

The harder the spring itself, the lower the residual shearing strain of the conventional coil spring steels, the SUP7 and SUP12V, is. In other words, if the spring is made harder, then the creep resistance is increased in proportion. The hardness of the spring is expressed in Brinell indentation diameter (hereinafter referred to as HBD). The HBD is the diameter of an indentation formed by pressing a cemental carbide ball, e.g., tungsten carbide ball, 10 mm in diameter into the surface of a sample with a load of 3,000 kgf.

The hardness of the conventional coil spring steels ranges from $\phi$ 2.70 to 2.90 mm in HBD. In order to obtain a creep resistance higher than in the conventional case, therefore, the spring hardness should be increased to $\phi$ 2.50 to 2.70 mm in HBD.

If the hardness of the spring steels exceeds a certain level, however, their fracture toughness lowers, while their notch sensitivity increases. If the spring steels become hard, then their endurance limit is improved in proportion. If the spring hardness becomes harder than $\phi$ 2.60 mm in HBD, however, the endurance limit is subject to substantial variation. This is supposed to be attributable to lowered fracture toughness. Thus, the spring steels cannot be good for the service if they are only hardened.

Shot peening (hereinafter referred to as SP in some cases) is generally known as means for improving the durability of a spring. The shot peening is a process in which compressive residual stress is produced in the surface of the spring as an object of processing by dashing a number of shots against the spring. Shots harder than the spring must be used in order to produce a sufficient compressive residual stress on the spring surface to determine the durability of the spring.

In the high-hardness spring described above, however, the spring hardness becomes harder than the hardness of normal-hardness shots (about $\phi$ 2.70 mm in HBD), so that the sufficient compressive residual stress cannot be produced. Accordingly, the shots used must be harder than the spring. In the case of a high-hardness spring with the hardness of $\phi$ 2.50 to 2.70 mm in HBD, for example, shots with the hardness of $\phi$ 2.50 mm or more harder in HBD should be used.

The harder the shots, however, the shorter their life is, as shown in FIG. 7. The life of the aforesaid high-hardness shots with the hardness of $\phi$ 2.50 mm or more in HBD, in particular, is much shorter than that of the conventional normal-hardness shots ($\phi$ 2.70 mm in HBD), and is not practical at all.

For these reasons, it has been believed that the hardness of the spring steels practically cannot be increased to $\phi$ 2.50 to 2.70 mm in HBD for lightweight design.

SUMMARY OF THE INVENTION

Accordingly, the object of the present invention is to provide a high-strength spring and a manufacturing method therefor, in which the spring hardness can be increased to $\phi$ 2.50 to 2.70 mm in HBD to improve the creep resistance of the spring without lowering its fracture toughness, and a sufficient residual stress can be produced with use of long-lived normal-hardness shots, so that improvement of the durability of the spring and reduction of the spring weight can be achieved at the same time.

A high-strength spring according to the present invention, developed in order to achieve the above object, is a high-strength spring which has the maximum shearing stress of 110 to 135 kgf/mm$^2$ (1080 to 1325 MPa), which is made of a spring steel containing 0.35 to 0.50% of carbon and refined to the hardness of $\phi$ 2.50 to 2.70 mm in HBD by rapid cooling for quenching, tempering, etc., and shot-peened at a temperature of 150° to 300° C. (423 to 573 K.). The term "maximum shearing stress" means the greatest shearing stress which can be applied to the spring after the spring has been incorporated in automobiles or other machines and apparatuses.

When the spring steel is hardened to $\phi$ 2.50 to 2.70 mm in HBD, its fracture toughness must be equal to or higher than that of the conventional springs with their upper-limit hardness of $\phi$ 2.70 mm in HBD. In the conventional coil spring steel SUP7 (carbon content: 0.6%), as indicated by hatching in FIG. 1, the fracture toughness value obtained with use of the spring hardness of $\phi$ 2.70 to 2.90 mm in HBD ranges from 120 to 200 kgf/mm$^{3/2}$ (37 to 62 MPa.m$^{\frac{1}{2}}$).

If the spring hardness is increased to $\phi$ 2.50 mm in HBD with use of this conventional spring steel, in order to improve the creep resistance of the spring, the fracture toughness value of the spring steel containing 0.6% of carbon is lowered to 80 kgf/mm$^{3/2}$ (25 MPa.m$^{\frac{1}{2}}$), as indicated by circles in FIG. 1. If the carbon content becomes lower, however, the fracture toughness value of the spring steel tends to increase in proportion. Even with use of the hardness of $\phi$ 2.50 mm in HBD, therefore, the fracture toughness value of 120 kgf/mm$^{3/2}$ (37 MPa.m$^{1/2}$) or more can be obtained by holding down the carbon content to 0.5% or less. Since the reduction of the carbon content entails lowering of the quench hardness, however, the carbon content should not be recklessly lowered. The carbon content must be kept at 0.35% or more in order to obtain the hardness of $\phi$ 2.50 mm in HBD. Accordingly, the carbon content of the spring steel used in the present invention is restricted to the range from 0.35 to 0.50%.

In the spring steel with the relatively low carbon content described above, a satisfactory hardenability can be ensured by adding 0.3 to 1.5% of manganese. Also, the creep resistance can be improved by adding 2.0 to 3.0% of silicon, which is higher than the silicon content of the conventional steels. The creep resistance and fracture toughness can be further improved by adding one or more elements, selected from a group of elements including 1.0 to 2.0% of nickel, 0.05 to 2.0% of molybdenum, 0.05 to 0.5% of vanadium, and 0.01 to 0.5% of niobium, depending on the working stress, as well as 0.1 to 2.0% of chromium. In FIG. 1, black spots represent the relationship between the carbon content and fracture toughness value of the spring steel containing these additive elements.

The present invention is intended to provide a high-durability, high-hardness spring by obtaining the aforementioned fracture toughness value (120 kgf/mm$^{3/2}$ or more) (37 MPa.m$^{1/2}$ or more) with use of the carbon content of 0.35 to 0.50%. Further, the present invention is characterized in that a spring steel hardened to $\phi$ 2.50 to 2.70 mm in HBD is subjected to warm shot peening (hereinafter referred to also as WSP) so that a sufficient compressive residual stress can be applied to the steel by means of normal-hardness shots.

FIG. 2 shows one of the results of experiments conducted by the inventors hereof, illustrating influences of SP temperature and spring hardness on the durability of the spring. When the shot peening is carried out at room temperature, high-hardness springs with the hardness of $\phi$ 2.60 mm in HBD are subject to a greater variation in durability than springs with the hardness of $\phi$ 2.80 mm in HBD, and some of the former are lower in durability frequency than the latter.

In the case of WSP at a temperature not lower than room temperature, on the other hand, the durability of the spring is improved as the SP temperature increases up to about 200° C. (473 K.). In other words, the higher the SP temperature, the more effectively the compressive residual stress can be produced. This tendency is more strongly in evidence in the case of the high-hardness spring with the hardness of $\phi$ 2.60 mm in HBD than in the case of the conventional spring with the hardness of $\phi$ 2.80 mm in HBD. In the case of WSP at 150° C. (423 K.) or more, in particular, the durability frequency of the $\phi$ 2.60-mm spring is much higher than the $\phi$ 2.80-mm spring.

Thus, the WSP is effective for the improvement of the durability of the high-hardness spring, in particular. The present invention is characterized in that the WSP is carried out at a temperature such that the surface temperature of the spring ranges from 150° to 300° C. (423 to 573 K.), and that the effect of the WSP is high enough to produce a high compressive residual stress. In some cases, a higher compressive residual stress may be obtained by effecting the WSP in a plurality of cycles. It is advisable to carry out a second cycle of shot peening and its subsequent cycles at a temperature not higher than 300° C. (573 K.), and the shot size may be varied between first and second cycles.

The present invention may be applied to a case in which a spring is refined to the aforesaid hardness after a spring steel is formed for a desired spring shape, and also to a case in which a straight spring steel, previously refined to the aforesaid hardness by oil tempering or the like, is cool-formed into a spring having a desired shape, such as a coil spring.

FIG. 3 shows residual stress distributions obtained under three SP conditions. In a first SP condition, a high-hardness spring with the hardness of $\phi$ 2.60 mm in HBD is subjected to WSP using normal-hardness shots ($\phi$ 2.65 to 2.80 mm in HBD). A residual stress distribution obtained in this case is represented by curve R1 in FIG. 3. In a second SP condition, SP is carried out at room temperature by using high-hardness shots ($\phi$ 2.30 to 2.50 mm in HBD). A residual stress distribution obtained in this case is represented by curve R2. In a third SP condition, SP is carried out at room temperature by using normal-hardness shots ($\phi$ 2.65 to 2.80 mm in HBD). A residual stress distribution obtained in this case is represented by curve R3.

In any of the three SP conditions described above, the spring steel contains, as its components, 0.40% of carbon, 2.5% of silicon, 0.75% of manganese, 0.80% of chromium, 1.80% of nickel, 0.40% of molybdenum, 0.20% of vanadium, all by weight, and iron and impurities for the remainder. This spring steel (hereinafter referred to as steel A) was hot-formed, and refined to the hardness of $\phi$ 2.60 mm in HBD by rapid cooling for quenching and tempering, and thereafter, SP was carried out under the aforementioned three conditions.

In the SP using the high-hardness shots with the hardness of $\phi$ 2.30 to 2.50 mm in HBD, the compressive residual stress obtained is generally higher than in the case of the SP using the normal-hardness shots (curve R3), as indicated by curve R2. Despite the use of the normal-hardness shots, the WSP can provide the highest compressive residual stress, as indicated by curve R1.

FIG. 4 shows the results of durability tests for the individual SP conditions. As in the case of the residual stress distributions described above, springs subjected to the WSP according to the present invention exhibited the highest durability.

According to the present invention, the fracture toughness can be prevented from lowering even though the hardness of the spring steel is increased, and a satisfactory compressive residual stress can be produced by the WSP using long-lived practical shots with normal hardness. For these reasons, the high-hardness spring of the invention can enjoy greatly improved creep resistance and durability, and hence, high-strength design and drastically reduced weight.

The following is a description of the upper and lower limits of the effects and contents of the additive elements mentioned before.

Mn: Manganese is an effective element for the improvement of the hardenability of steel, and has no effect when its content is lower than 0.3%. If the content exceeds 1.5%, the hardenability of the steel becomes so high that deformation or quenching crack is liable to be caused.

Si: Silicon is an effective element for the improvement of the strength of steel and the creep resistance of the resulting spring. The creep resistance of the steel can be made higher than that of the conventional spring steels by adding 2.0% or more of silicon. The silicon content is restricted to an upper limit of 3.0% in order to prevent the generation of free carbon materials during heat treatment.

Cr: Chromium is an effective element for preventing steel from being decarbonized or graphitized. No effect can be produced when the chromium content is lower than 0.1%. If the content exceeds 2.0%, the toughness is lowered.

Ni: Nickel is an effective element for the improvement of the toughness of steel after heat treatment. Although an effect can be produced when the nickel content is 0.5% or more, the lower limit of the content for a greater effect is set at 1.0%. If the content exceeds 2.0%, the amount of residual austenite after the heat treatment increases. Thus, the upper limit of the content is set at 2.0%.

Mo: Molybdenum is an effective element for the improvement of the strength of steel and the creep resistance of the resulting spring. No effect can be produced when the molybdenum content is lower than 0.05%. If the content exceeds 2.0%, the effect is saturated.

V: Vanadium is an effective element for the improvement of the creep resistance, which has a crystal grain refining effect for cold rolling of steel, and is conducive to precipitation hardening at the time of rapid cooling for quenching and tempering. No effect can be produced when the vanadium content is lower than 0.05%. If the content exceeds 0.5%, the toughness is lowered.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

A high-strength coil spring according to an embodiment of the present invention is manufactured in the following manner. The aforesaid rod-shaped straight steel A is heated to be austenitized at 970° C. (1243 K.), and then formed into a coil. The resulting structure is rapidly cooled for quenching in oil, and then kept at 350° C. (623 K.) for 60 minutes (3.6Ks). Thereupon, a coil spring tempered to the hardness of $\phi$ 2.55 to 2.65 mm in HBD is obtained.

The coil spring thus obtained is subjected to a first cycle of WSP at a temperature of 150° to 300° C. (423 to 573 K.). The arc height for this first cycle is 0.40 mm. Immediately after the first cycle of WSP is executed, a second cycle of WSP is executed. The arc height for the second cycle is 0.25 mm. In both cycles, the shot hardness ranges from $\phi$ 2.65 to 2.80 mm in HBD. After the second cycle of WSP is executed, the coil spring is subjected to a setting process in the same manner as the conventional coil spring, and is then coated by paint.

The following is a description of the results of comparison between the respective creep resistances and durabilities of the coil spring according to the present invention, manufactured in this manner, and the conventional springs.

The creep resistancce is one of essential factors which determine the design stress of the coil spring. The high-temperature creep resistance is a particularly important factor. In this case, the high temperature is at 80° C. (353 K.) or thereabout, for example.

Figure 1:
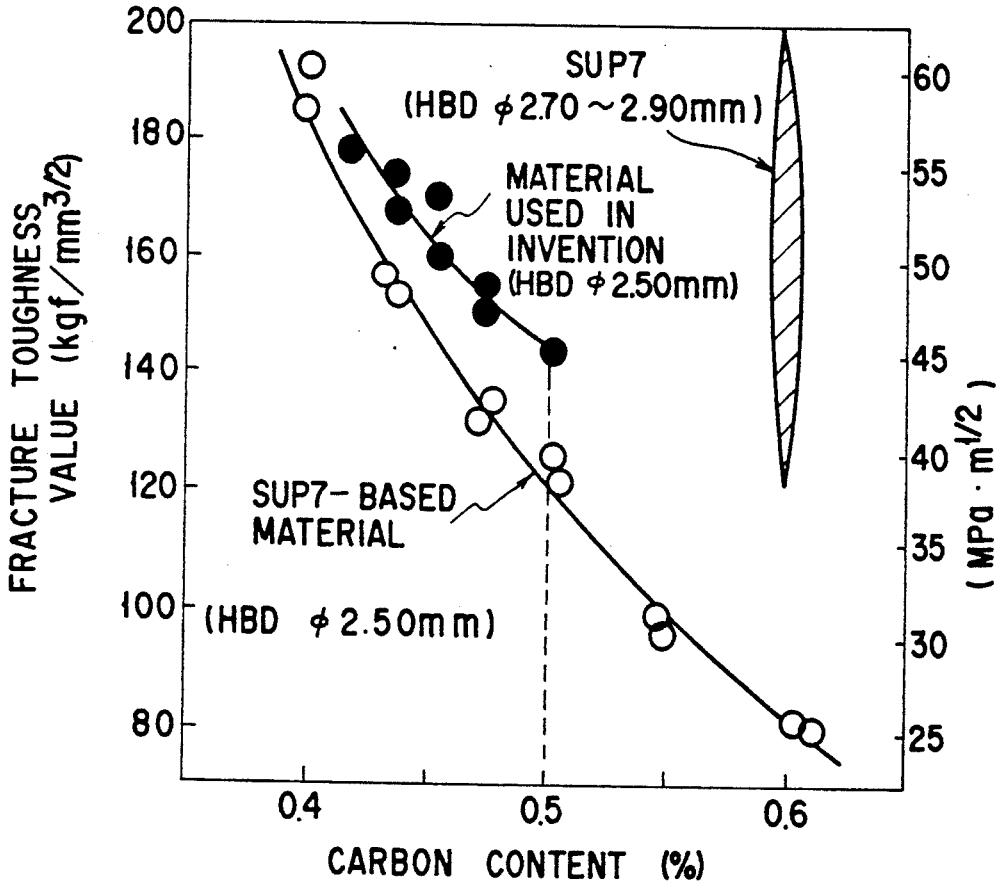
FIG. 1 is a diagram showing the relationship between carbon content and fracture toughness value.
Figure 2:
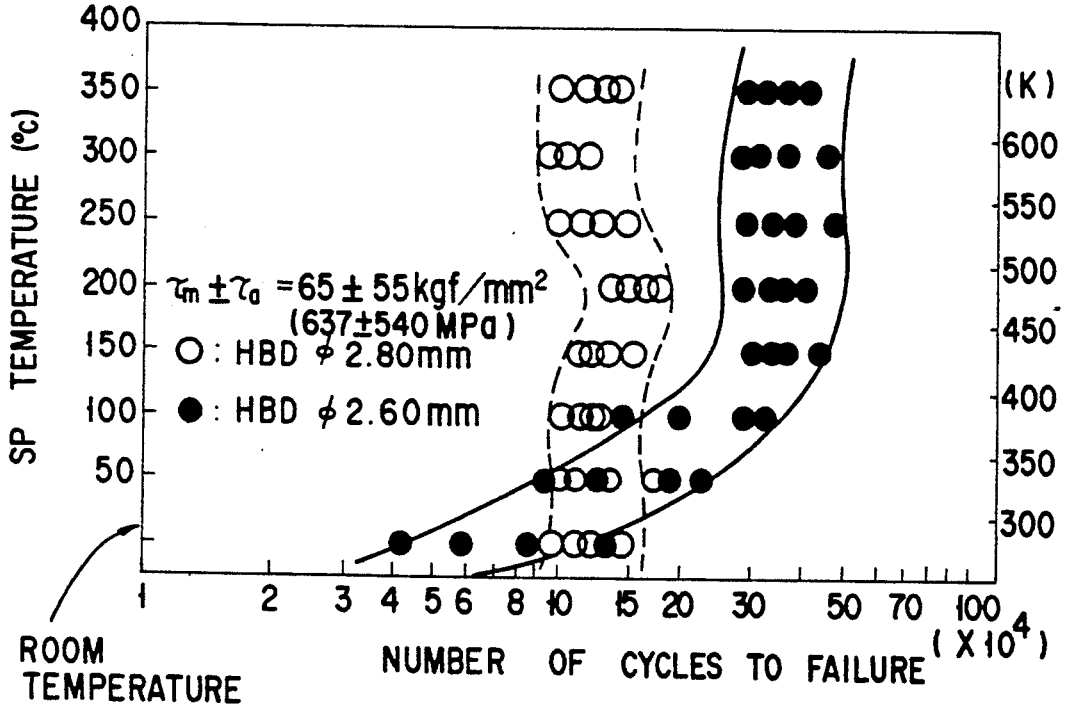
FIG. 2 is a diagram illustrating influences of SP temperature and spring hardness on number of cycles to failure.
Figures 3, 4:
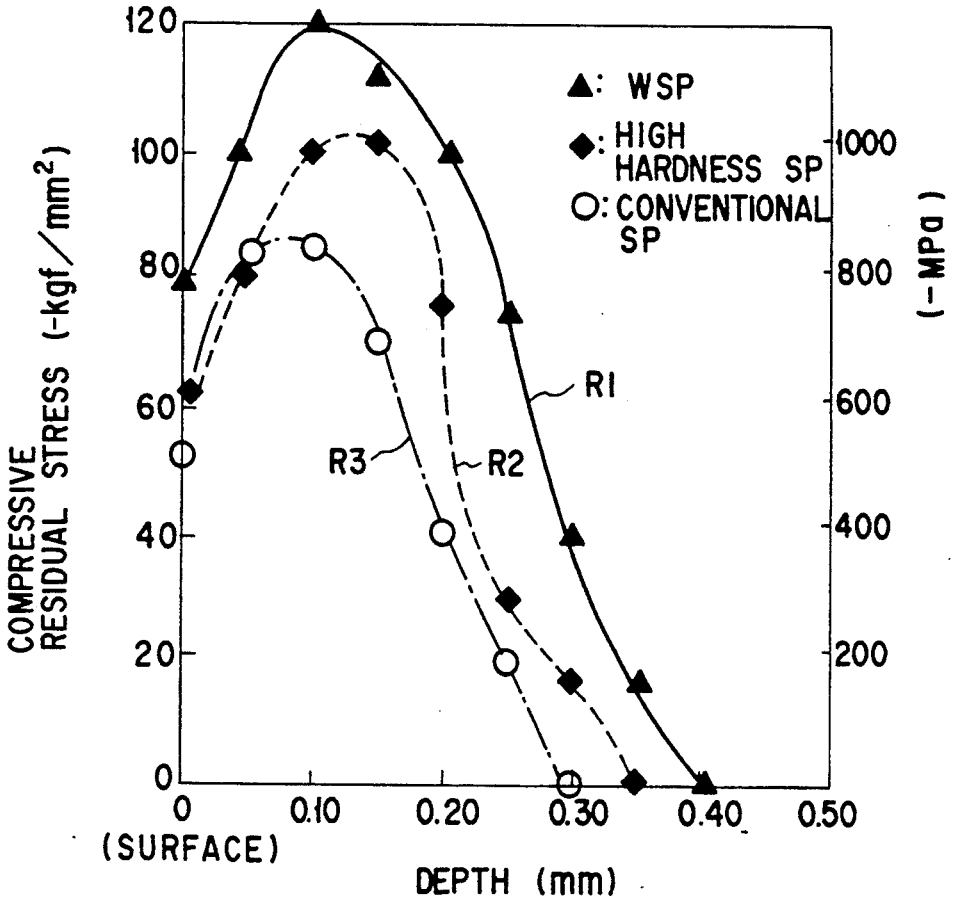
FIG. 3 is a diagram showing residual stress distributions under three SP conditions.
FIG. 4 is a diagram comparatively showing number of cycles to failure under the three SP conditions.
Figure 5:
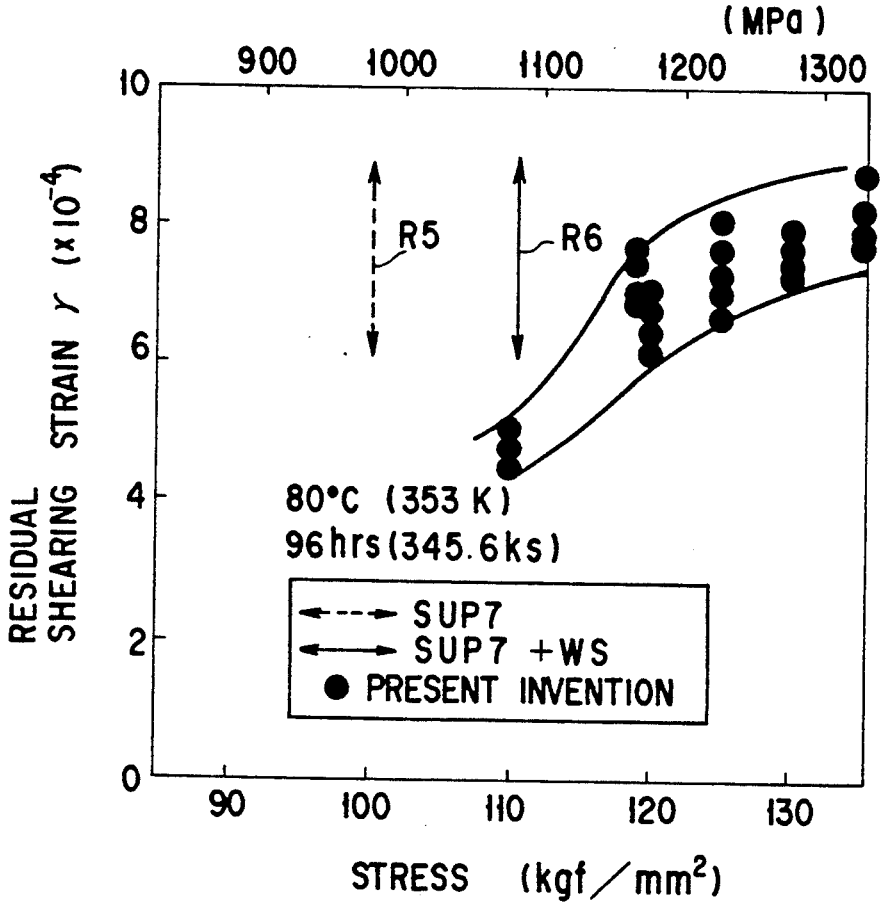
FIG. 5 is a diagram showing the relationship between clamping stress and residual shearing strain.

FIG. 5 shows the relationship between clamping stress and residual shearing strain obtained when coil spring samples are clamped under a predetermined load and left to stand at 80° C. (353 K.) for 96 hours (345.6Ks). As seen from FIG. 5, residual shearing strain of products according to the present invention is substantially equal to that of the conventional products, although their clamping stress is higher.

In the conventional steel SUP7, the residual shearing strain $\gamma$ ranges from $6\times10^{-4}$ to $9\times10^{-4}$ when the clamping stress is at 100 kgf/mm$^2$ (980 MPa), as indicated by broken line R5 in FIG. 5. If the SUP7 is subjected to warm setting (WS), the residual shearing strain $\gamma$ ranges from $6\times10^{-4}$ to $9\times10^{-4}$ when the clamping stress is at 110 kgf/mm$^2$ (1080 MPa), as indicated by full line R6. In the case of the coil spring samples according to the present invention, the clamping stress can be as high as 135 kgf/mm$^2$ (1325 MPa) when the residual shearing strain is equal to that of the conventional products. Thus, the maximum design stress can be set at a higher value than the value for the conventional products.

The following is a description of the durability of the products according to the present invention compared with that of the conventional products.

Figure 6:
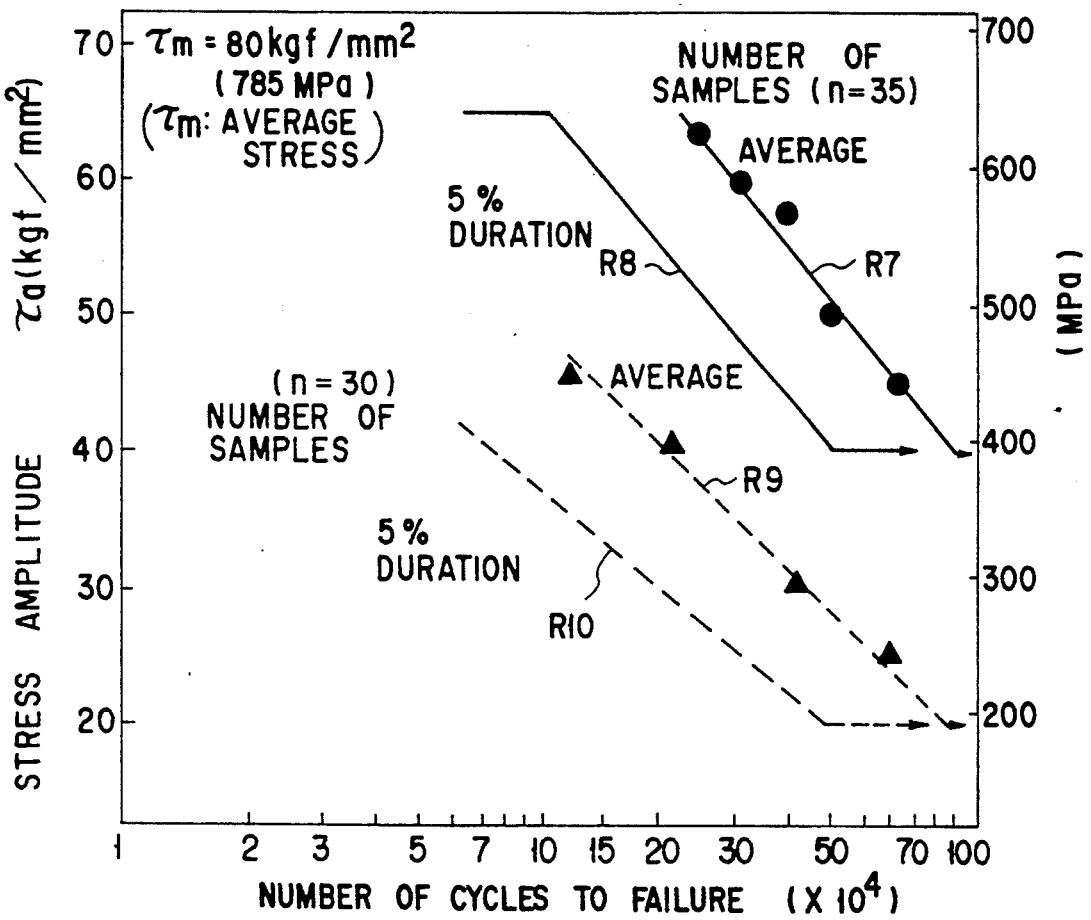
FIG. 6 is a diagram comparatively showing the respective durabilities of products according to the present invention and conventional products.
Figure 7:
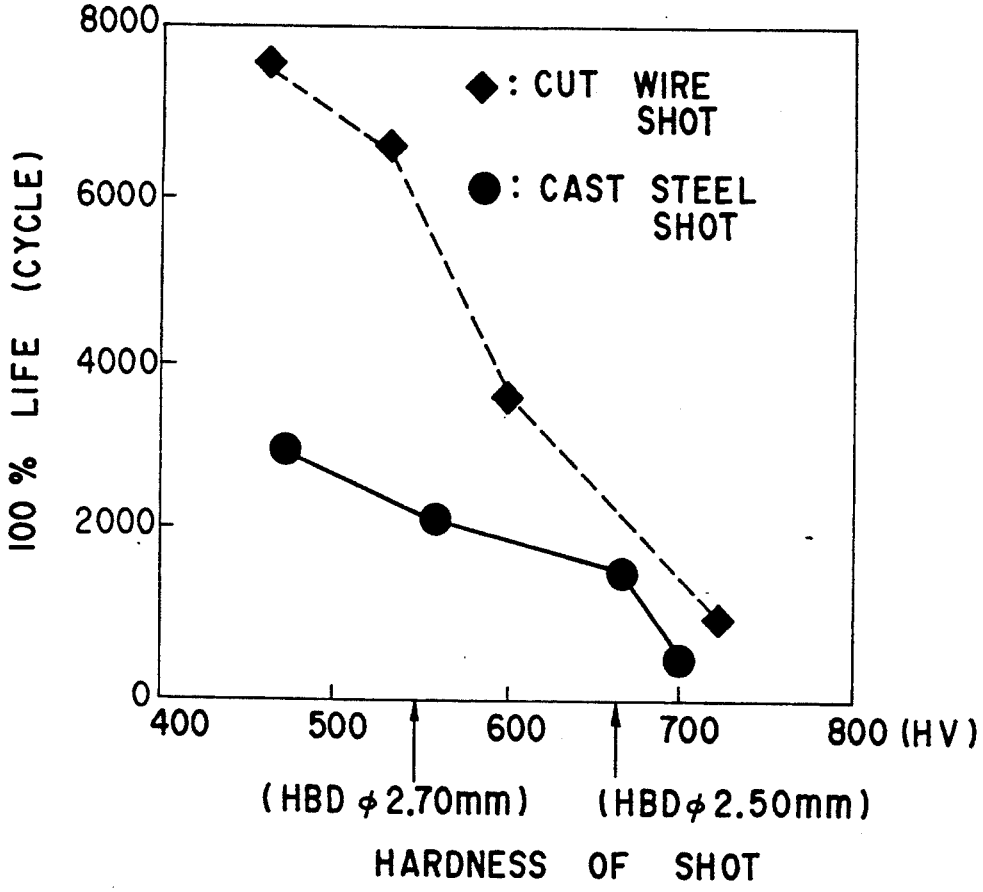
FIG. 7 is a diagram showing the relationship between hardness of shot and life.

FIG. 6 shows the results of durability tests conducted in atmosphere. In FIG. 6, full line R7 represents the average values for the products of the invention, and full line R8 represents the 5%-duration of the products of the invention. Likewise, broken line R9 represents the average values for the conventional products, and broken line R10 represents the 5%-duration of the conventional products. In either case, the number of samples is 30, and the average stress $\tau_m$ is 80 kgf/mm$^2$ (785 MPa).

As is evident from these durability test results, the durability of the coil spring samples according to the present invention is much higher than that of the conventional products. For the durability of 200,000 cycles with respect to the 5%-duration, for example, the stress amplitude $\tau_a$ of the conventional products is limited to $\tau_a$=30 kgf/mm$^2$ (294 MPa), while that of the products of the invention can obtain the same durability at high value of $\tau_a = 55$ kgf/mm$^2$ (540 MPa). The maximum design stress of the products of the invention can be set at (80 kgf/mm$^2$+55 kgf/mm$^2$)=135 kgf/mm$^2$ that is (785 MPa+540 MPa)=1325 MPa.

The products of the present invention enjoying the maximum design stress of 120 kgf/mm$^2$ (1177 MPa) or thereabout can be made 30% lighter in weight than the conventional product whose maximum design stress is $\tau_{max} = 100$ kgf/mm$^2$ (980 MPa). Further, the products of the present invention enjoying the maximum design stress of 130 kgf/mm$^2$ (1275 MPa) or thereabout can be made lighter in weight than the same conventional product by as high as 40%. The present invention can be applied to torsion bars, stabilizers, leaf springs, etc., as well as coil springs.

What is claimed is:

1. A method for manufacturing a high-strength spring having a maximum shearing stress of 110 to 135 kgf/mm$^2$ (1080 to 1325 MPa), comprising steps of:

refining a spring steel containing 0.35 to 0.50% by weight of carbon to a hardness of $\phi$ 2.50 to 2.70 mm in Brinell indentation diameter; and subjecting the refined spring steel to warm shot peening at a temperature of 150° to 300° C. (423 to 573 K.).

2. A manufacturing method according to claim 1, wherein said spring steel contains 0.35 to 0.50% of carbon, 0.3 to 1.5% of manganese, 2.0 to 3.0% of silicon, 0.1 to 2.0% of chromium, all by weight, and iron for the greater part of the remainder.

3. A manufacturing method according to claim 1, wherein said spring steel is refined to a hardness of $\phi$ 2.50 to 2.70 mm in Brinell indentation diameter by rapid cooling for quenching and tempering.

4. A manufacturing method according to claim 1, wherein the hardness of shots used for the warm shot peening ranges from $\phi$ 2.65 to 2.80 mm in Brinell indentation diameter.

5. A manufacturing method according to claim 1, wherein a second cycle of warm shot peening is carried out under a different shot peening condition after said warm shot peening is finished.

* * * * *